US011629597B2

(12) United States Patent
Kwak

(10) Patent No.: US 11,629,597 B2
(45) Date of Patent: Apr. 18, 2023

(54) TIE ROD ASSEMBLY STRUCTURE, GAS TURBINE HAVING SAME, AND TIE ROD ASSEMBLY METHOD

(71) Applicant: DOOSAN ENERBILITY CO., LTD, Changwon-si (KR)

(72) Inventor: Young Seob Kwak, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 62 days.

(21) Appl. No.: 17/359,571

(22) Filed: Jun. 27, 2021

(65) Prior Publication Data

US 2022/0065110 A1 Mar. 3, 2022

(30) Foreign Application Priority Data

Aug. 28, 2020 (KR) ..... 10-2020-0109381

(51) Int. Cl.
*F01D 5/06* (2006.01)
*F01D 25/24* (2006.01)
*F01D 25/16* (2006.01)

(52) U.S. Cl.
CPC ..... *F01D 5/066* (2013.01); *F01D 25/162* (2013.01); *F01D 25/243* (2013.01); *F05D 2260/31* (2013.01)

(58) Field of Classification Search
CPC ..... F01D 5/066; F01D 25/162; F01D 25/243; F01D 5/025; F05D 2260/31; F05D 2260/30
See application file for complete search history.

(56) References Cited

U.S. PATENT DOCUMENTS

| | | | | |
|---|---|---|---|---|
| 4,915,589 | A * | 4/1990 | Gessler | F01D 5/025 415/217.1 |
| 7,470,115 | B2 | 12/2008 | Meach | |
| 7,510,380 | B2 * | 3/2009 | Alam | F01D 5/027 416/244 R |
| 10,443,541 | B2 | 10/2019 | Chakkera | |
| 2006/0013693 | A1 | 1/2006 | Meacham | |
| 2013/0074518 | A1 | 3/2013 | Palmer | |
| 2013/0094951 | A1 | 4/2013 | McCaffrey | |
| 2015/0078915 | A1 | 3/2015 | Wasserman | |

(Continued)

FOREIGN PATENT DOCUMENTS

| | | | |
|---|---|---|---|
| EP | 2007011134 | A1 | 12/2008 |
| JP | 2003113797 | A | 4/2003 |

(Continued)

OTHER PUBLICATIONS

KR OA dated Jan. 7, 2022.

*Primary Examiner* — Courtney D Heinle
*Assistant Examiner* — Andrew Thanh Bui
(74) *Attorney, Agent, or Firm* — Harvest IP Law, LLP

(57) ABSTRACT

A tie rod assembly structure, a gas turbine having the same, and a method of assembling tie rod are provided. The tie rod assembly structure includes a tie rod on which a plurality of rotor disks are mounted, a bearing support shaft mounted to the tie rod to support the rotor disks and on which a bearing is mounted, a first nut mounted on the tie rod on one side of the bearing support shaft, and a second nut that is fastened to the first nut to tension the tie rod and then is in close contact with the bearing support shaft to support the bearing support shaft.

20 Claims, 10 Drawing Sheets

(56) References Cited

U.S. PATENT DOCUMENTS

| | | | | |
|---|---|---|---|---|
| 2015/0096304 | A1* | 4/2015 | von der Esch | F01D 5/06 60/796 |
| 2015/0233581 | A1* | 8/2015 | Cutler | F02C 7/22 60/739 |
| 2016/0363156 | A1 | 12/2016 | Yonker | |
| 2020/0392849 | A1* | 12/2020 | Di Paola | F01D 5/026 |

FOREIGN PATENT DOCUMENTS

| | | | |
|---|---|---|---|
| JP | 2010065701 | A | 3/2010 |
| JP | 5925788 | B2 | 5/2016 |
| JP | 6203252 | B2 | 9/2017 |
| KR | 1616630 | B1 | 3/2016 |
| KR | 1020150087198 | A | 5/2020 |

* cited by examiner

TIE ROD ASSEMBLY STRUCTURE, GAS TURBINE HAVING SAME, AND TIE ROD ASSEMBLY METHOD

CROSS REFERENCE TO RELATED APPLICATION

This application claims priority to Korean Patent Application No. 10-2020-0109381, filed on Aug. 28, 2020, the disclosure of which is incorporated herein by reference in its entirety.

BACKGROUND

1. Field

Apparatuses and methods consistent with exemplary embodiments relate to a tie rod assembly structure, a gas turbine having the same, and a method of assembling tie rod.

2. Description of the Related Art

A turbine is a mechanical device that obtains a rotational force by an impulsive force or reaction force using a flow of a compressible fluid such as steam or gas. The turbine includes a steam turbine using a steam and a gas turbine using a high temperature combustion gas.

The gas turbine includes a compressor, a combustor, and a turbine. The compressor includes an air inlet into which air is introduced, and a plurality of compressor vanes and compressor blades which are alternately arranged in a compressor housing.

The combustor supplies fuel to the compressed air compressed in the compressor and ignites a fuel-air mixture with a burner to produce a high temperature and high pressure combustion gas.

The turbine includes a plurality of turbine vanes and turbine blades which are alternately arranged in a turbine housing. Further, a rotor is disposed passing through center of the compressor, the combustor, the turbine and an exhaust chamber.

The rotor is rotatably supported at both ends thereof by bearings. A plurality of disks are fixed to the rotor and the plurality of blades are coupled to corresponding disks, respectively. A driving shaft of a generator is connected to an end of the rotor that is adjacent to the exhaust chamber.

The gas turbine does not have a reciprocating mechanism such as a piston which is usually provided in a four-stroke engine. That is, the gas turbine has no mutual frictional parts such as piston-cylinder, thereby having advantages in that consumption of lubricant is extremely small, an amplitude of vibration as a characteristic of a reciprocating machine is greatly reduced, and high speed operation is possible.

Briefly describing the operation of the gas turbine, the compressed air compressed by the compressor is mixed with fuel and combusted to produce a high-temperature combustion gas, which is then injected toward the turbine. The injected combustion gas passes through the turbine vanes and the turbine blades to generate a rotational force by which the rotor is rotated.

In a related art, a plurality of rotor disks are attached to a tie rod with a nut fastened thereto by mounting the rotor disks on the tie rod and tightening the nut after the tie rod is tensioned.

However, when the tie rod is tensioned, the thread of the nut fastened to the tie rod is also tensioned and deformed, so there is a problem that the nut does not rotate and tighten after tension.

The foregoing is intended merely to aid in the understanding of the background of the present disclosure, and is not intended to mean that the present disclosure falls within the purview of the related art that is already known to those skilled in the art.

SUMMARY

Aspects of one or more exemplary embodiments provide a tie rod assembly structure in which a tie rod can be easily assembled without need to tighten a nut whose thread may be deformed when the tie rod is tensioned, a gas turbine having the same, and a method of assembling a tie rod.

Additional aspects will be set forth in part in the description which follows and, in part, will become apparent from the description, or may be learned by practice of the exemplary embodiments.

According to an aspect of an exemplary embodiment, there is provided a tie rod assembly structure including: a tie rod on which a plurality of rotor disks are mounted; a bearing support shaft mounted to the tie rod to support the rotor disks and on which a bearing is mounted; a first nut mounted on the tie rod on one side of the bearing support shaft; and a second nut that is screwed to the first nut to tension the tie rod and then is in close contact with the bearing support shaft to support the bearing support shaft.

The bearing support shaft may include a rotor support that supports one side of the rotor disks, and a bearing mount that is integrally formed with the rotor support to support a bearing mounted on an outer circumferential surface thereof.

The bearing support shaft may further include at least one seal mounted on the rotor support.

The first nut may include: a tapered part inserted into one side of the bearing support shaft; a threaded part integrally formed with the tapered part and having a threaded outer circumferential surface; and a stepped part integrally formed with the threaded part and having a larger outer diameter than the threaded part.

The second nut may include: a body part mounted on the threaded part of the first nut; and a threaded part formed on an inner circumferential surface of the body part.

The outer diameter of the stepped part of the first nut may be the same as an outer diameter of the second nut and the bearing mount.

The first nut may further include a plurality of holes formed on an outer circumferential surface of the stepped part to rotate the first nut.

According to an aspect of another exemplary embodiment, there is provided a gas turbine including: a compressor configured to compress external air; a combustor configured to mix fuel with air compressed by the compressor to combust an air-fuel mixture; and a turbine having a turbine blade mounted on a turbine rotor disk and configured to be rotated by the combustion gas discharged from the combustor, wherein the turbine includes: a tie rod on which a plurality of rotor disks are mounted; a bearing support shaft mounted to the tie rod to support the rotor disks and on which a bearing is mounted; a first nut mounted on the tie rod on one side of the bearing support shaft; and a second nut that is screwed to the first nut to tension the tie rod and then is in close contact with the bearing support shaft to support the bearing support shaft.

The bearing support shaft may include a rotor support that supports one side of the rotor disks, and a bearing mount that is integrally formed with the rotor support to support a bearing mounted on an outer circumferential surface thereof.

The bearing support shaft may further include at least one seal mounted on the rotor support.

The first nut may include: a tapered part inserted into one side of the bearing support shaft; a threaded part integrally formed with the tapered part and having a threaded outer circumferential surface; and a stepped part integrally formed with the threaded part and having a larger outer diameter than the threaded part.

The second nut may include: a body part mounted on the threaded part of the first nut; and a threaded part formed on an inner circumferential surface of the body part.

The outer diameter of the stepped part of the first nut may be the same as the outer diameter of the second nut and the bearing mount.

The first nut may further include a plurality of holes formed on an outer circumferential surface of the stepped part to rotate the first nut.

According to an aspect of another exemplary embodiment, there is provided a method of assembling tie rod including: mounting a plurality of rotor disks on a tie rod; mounting a bearing support shaft on the tie rod; fastening a first nut to which a second nut is fastened to the tie rod; tensioning the tie rod with a tensioner; and screwing the second nut to come into close contact with one side of the bearing support shaft.

In fastening the first nut, the first nut to which the second nut is fastened may be fastened to the threaded tie rod so that the second nut is in close contact with one side of the bearing support shaft.

In tensioning the tie rod, the first nut may be moved a predetermined distance from one side of the bearing support shaft during the tensioning of the tie rod.

In screwing the second nut to come into close contact with one side of the bearing support shaft, the second nut may be fastened with respect to the first nut to support the bearing support shaft to prevent movement around the tie rod.

The tensioner may include a fastening part fastened to an end of the tie rod to tension the tie rod, a support bar extending from the fastening part toward a rotor support of the bearing support shaft, and a support pad provided on an end side of the support bar to elastically support one side of the rotor support of the bearing support shaft.

The tensioning the tie rod may include relatively moving the fastening part in a state in which the support pad is in close contact with the rotor support and the support bar is fixed.

According to one or more exemplary embodiments, the tie rod can be easily assembled because there is no need to tighten a nut whose thread may be deformed while tensioning the tie rod.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
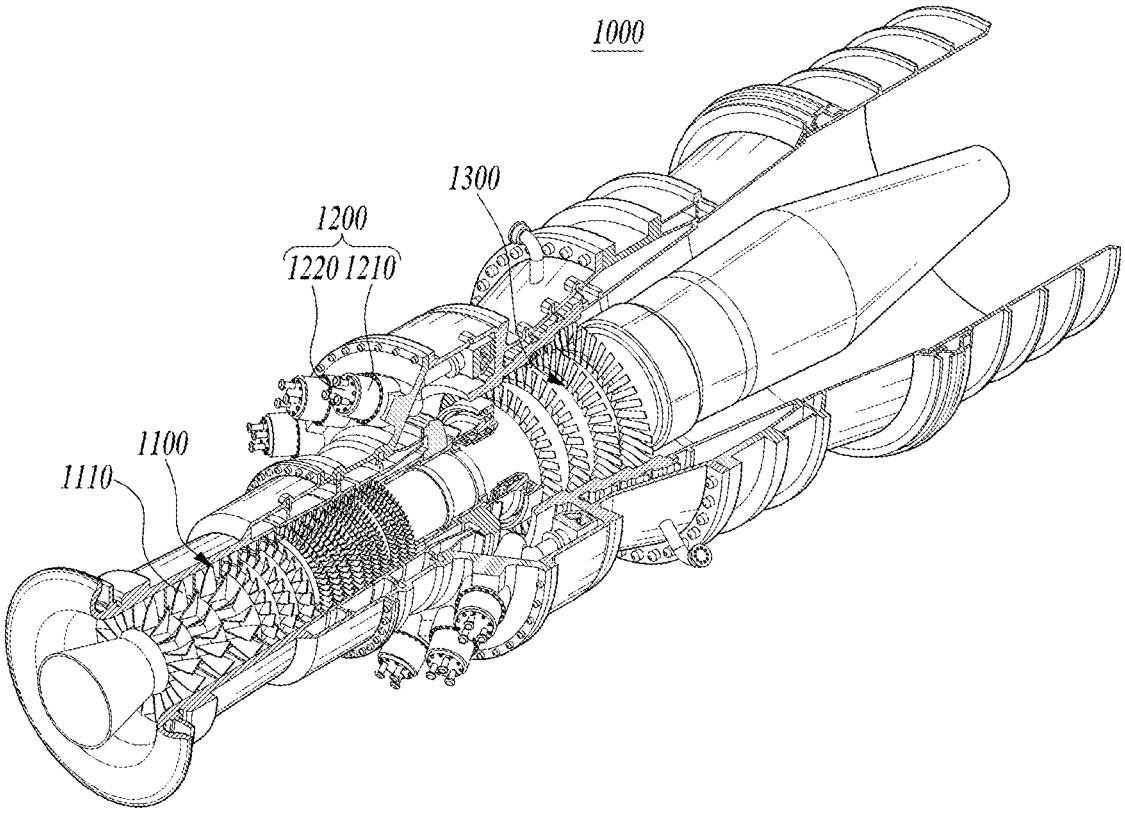
FIG. 1 is a partially cut-away perspective view of a gas turbine according to an exemplary embodiment.

Various modifications and various embodiments will be described in detail with reference to the accompanying drawings so that those skilled in the art can easily carry out the disclosure. However, it should be noted that the various embodiments are not for limiting the scope of the disclosure to the specific embodiment, but they should be interpreted to include all modifications, equivalents or substitutions of the embodiments included within the spirit and scope disclosed herein.

Terms used herein are for the purpose of describing specific embodiments only and are not intended to limit the scope of the disclosure. As used herein, an element expressed as a singular form includes a plurality of elements, unless the context clearly indicates otherwise. Further, terms such as "comprising" or "including" should be construed as designating that there are such features, numbers, steps, operations, elements, parts, or combinations thereof, not to exclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the different drawings and exemplary embodiments. In certain embodiments, a detailed description of known functions and configurations well known in the art will be omitted to avoid obscuring appreciation of the disclosure by a person of ordinary skill in the art. For the same reason, some elements are exaggerated, omitted, or schematically illustrated in the accompanying drawings.

Figure 2:
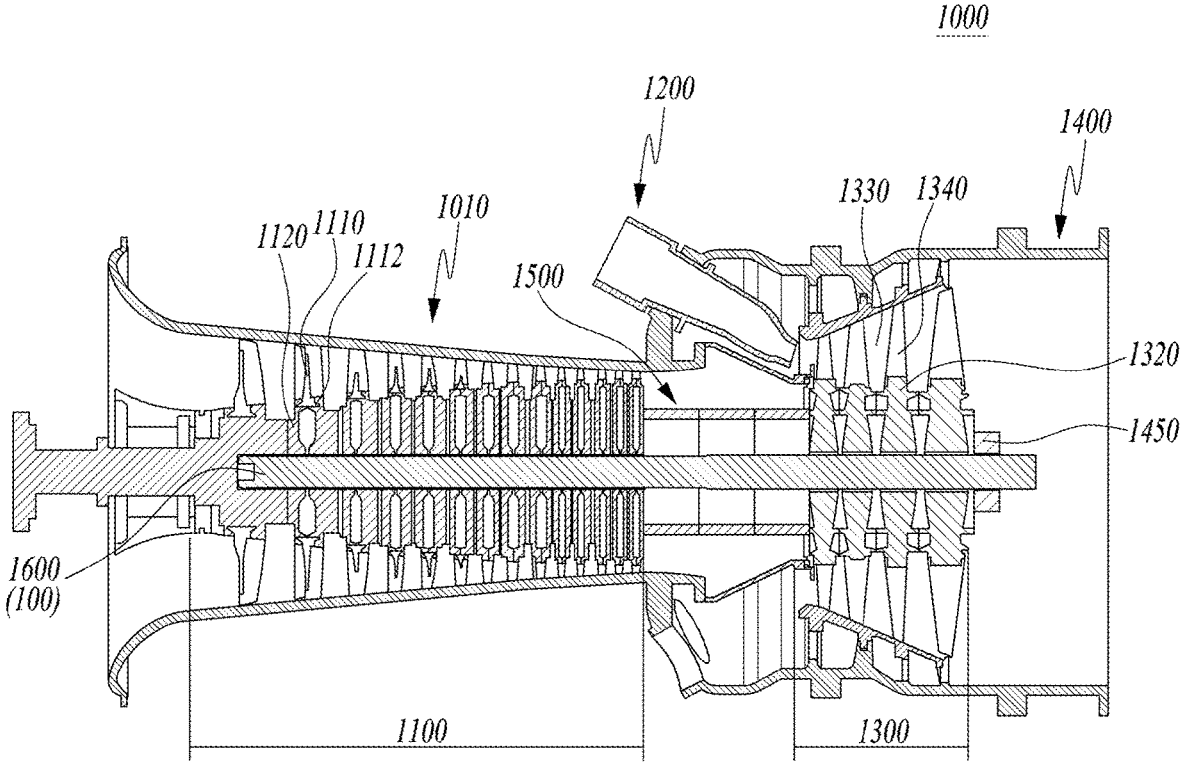
FIG. 2 is a cross-sectional view illustrating a schematic structure of a gas turbine according to an exemplary embodiment.
Figure 3:
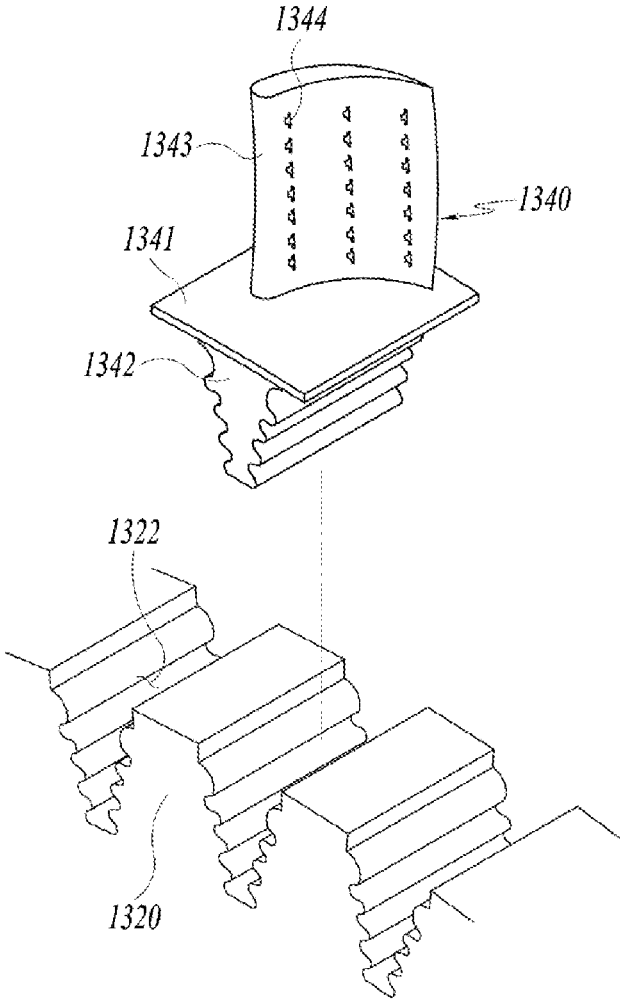
FIG. 3 is an exploded perspective view illustrating a turbine rotor disk of FIG. 2.

FIG. 1 is a partially cut-away perspective view of a gas turbine according to an exemplary embodiment, FIG. 2 is a cross-sectional view illustrating a schematic structure of a gas turbine according to an exemplary embodiment, and FIG. 3 is an exploded perspective view illustrating a turbine rotor disk of FIG. 2.

Referring to FIG. 1, a gas turbine 1000 according to an exemplary embodiment includes a compressor 1100, a combustor 1200, and a turbine 1300. The compressor 1100 includes a plurality of blades 1110 radially installed. The compressor 1100 rotates the plurality of blades 1110, and air is compressed and flows by the rotation of the plurality of blades 1110. A size and installation angle of each of the plurality of blades 1110 may vary depending on an installation location thereof. The compressor 1100 may be connected directly or indirectly to the turbine 1300, and receive a portion of the power generated by the turbine 1300 to rotate the plurality of blades 1110.

Air compressed by the compressor 1100 flows to the combustor 1200. The combustor 1200 includes a plurality of combustion chambers 1210 and a fuel nozzle module 1220 which are arranged in an annular shape.

Referring to FIG. 2, the gas turbine 1000 includes a housing 1010 and a diffuser 1400 which is disposed on a rear side of the housing 1010 to discharge a combustion gas passing through the turbine. The combustor 1200 is disposed in front of the diffuser 1400 to combust compressed air supplied thereto.

Based on a flow direction of air, the compressor 1100 is located at an upstream side of the housing 1010, and the turbine 1300 is located on a downstream side. A torque tube unit 1500 is disposed as a torque transmission member between the compressor 1100 and the turbine 1300 to transmit the rotational torque generated in the turbine 1300 to the compressor 1100.

The compressor 1100 includes a plurality of compressor rotor disks 1120, each of which is fastened by a tie rod 1600 to prevent axial separation thereof.

For example, the compressor rotor disks 1120 are axially arranged in such a way that the tie rod 1600 constituting a rotary shaft passes through central portion thereof. Here, adjacent compressor rotor disks 1120 are disposed so that facing surfaces thereof are in tight contact with each other by the tie rod 1600. The adjacent compressor rotor disks 1120 cannot rotate relative to each other because of this arrangement.

A plurality of blades 1110 are radially coupled to an outer circumferential surface of the compressor rotor disk 1120. Each of the plurality of blades 1110 has a dovetail part 1112 which is fastened to the compressor rotor disk 1120.

A plurality of compressor vanes are fixedly arranged between each of the compressor rotor disks 1120. While the compressor rotor disks 1120 rotate along with a rotation of the tie rod 1600, the compressor vanes fixed to the housing 1010 do not rotate. The compressor vane guides a flow of compressed air moved from front-stage compressor blades 1110 of the compressor rotor disk 1120 to rear-stage compressor blades 1110 of the rotor disk 1120.

The dovetail part 1112 may be fastened in a tangential type or an axial type, which may be selected according to the structure required for the gas turbine used. This type may have a dovetail shape or fir-tree shape. In some cases, the compressor blades 1110 may be fastened to the compressor rotor disk 1120 by using other types of fasteners such as keys or bolts.

The tie rod 1600 is arranged to pass through the center of the compressor rotor disks 1120 and turbine rotor disks 1320 such that one end thereof is fastened to the compressor rotor disk that is disposed at the most upstream side and the other end thereof is fastened by a fixing nut 1450. The tie rod 1600 may be a single tie rod or consist of a plurality of tie rods.

It is understood that the tie rod 1600 may have various shapes depending on the structure of the gas turbine, and is not limited to example shown in FIG. 2. For example, a single tie rod may be disposed to pass through central portions of the rotor disks, a plurality of tie rods may be arranged circumferentially, or a combination thereof may be used.

Also, a deswirler serving as a guide vane may be installed at the rear stage of the diffuser in order to adjust a flow angle of a pressurized fluid entering a combustor inlet to a designed flow angle.

The combustor 1200 mixes the introduced compressed air with fuel, combusts the air-fuel mixture to produce a high-temperature and high-pressure combustion gas, and increases the temperature of the combustion gas to the heat resistance limit that the combustor and the turbine components can withstand through an isobaric combustion process.

A plurality of combustors constituting the combustor 1200 may be arranged in the housing in a form of a cell. Each of the combustors includes a burner having a fuel injection nozzle and the like, a combustor liner forming a combustion chamber, and a transition piece as a connection between the combustor and the turbine.

The combustor liner provides a combustion space in which the fuel injected by the fuel injection nozzle is mixed with the compressed air supplied from the compressor and the fuel-air mixture is combusted. The combustor liner may include a flame canister providing a combustion space in which the fuel-air mixture is combusted, and a flow sleeve forming an annular space surrounding the flame canister. The fuel injection nozzle is coupled to a front end of the combustor liner, and an igniter plug is coupled to a side wall of the combustor liner.

The transition piece is connected to a rear end of the combustor liner to transmit the combustion gas combusted by the igniter plug to the turbine. An outer wall of the transition piece is cooled by the compressed air supplied from the compressor to prevent the transition piece from being damaged by the high temperature combustion gas.

To this end, the transition piece is provided with cooling holes through which compressed air is injected into and cools inside of the transition piece and flows towards the combustor liner.

The compressed air that has cooled the transition piece flows into the annular space of the combustor liner and is supplied as a cooling air to an outer wall of the combustor liner from the outside of the flow sleeve through cooling holes provided in the flow sleeve so that air flows may collide with each other.

The high-temperature and high-pressure combustion gas ejected from the combustor 1200 is supplied to the turbine 1300. The supplied high-temperature and high-pressure combustion gas expands and collides with and provides a reaction force to rotating blades of the turbine to generate a rotational torque. A portion of the rotational torque is transmitted to the compressor through the torque tube, and remaining portion which is an excessive torque is used to drive a generator or the like.

The turbine 1300 is basically similar in structure to the compressor. That is, the turbine 1300 also includes a plurality of turbine rotor disks 1320 similar to the compressor rotor disks of the compressor. Thus, the turbine rotor disk 1320 also includes a plurality of turbine blades 1340 disposed radially. The turbine blade 1340 may also be coupled to the turbine rotor disk 1320 in a dovetail coupling manner. Between the turbine blades 1340 of the turbine rotor disk 1320, a plurality of turbine vanes 1330 fixed to the housing are provided to guide a flow direction of the combustion gas passing through the turbine blades 1340.

Referring to FIG. 3, the turbine rotor disk 1320 has a substantially disk shape, and includes a plurality of coupling slots 1322 formed in an outer circumferential portion thereof. Each of the coupling slots 1322 has a fir-tree-shaped curved surface.

Each of the turbine blades 1340 is fastened to an associated one of the coupling slots 1322 and includes a planar platform part 1341 formed in an approximately center thereof. The platform part 1341 has a side surface which comes into contact with a side surface of the platform part 1341 of an adjacent turbine blade to maintain a gap between the adjacent blades.

A root part 1342 is formed on a bottom surface of the platform part 1341. The root part 1342 has an axial-type shape so that the root 1342 is inserted along an axial direction of the turbine rotor disk 1320 into the coupling slot 1332 of the turbine rotor disk 1320.

The root part 1342 has a substantially fir-tree-shaped curved surface corresponding to the fir-tree-shape curved surface of the coupling slot 1322. It is understood that the coupling structure of the root part 1342 is not limited to the fir-tree shape, and may be formed to have a dovetail shape.

A blade part 1343 is formed on an upper surface of the platform part 1341 to have an optimized airfoil shape according to the specification of the gas turbine. Based on a flow direction of combustion gas, the blade part 1343 has a leading edge disposed at an upstream side and a trailing edge disposed at a downstream side.

The turbine blades come into direct contact with the high-temperature and high-pressure combustion gas. Because the temperature of the combustion gas has a high temperature reaching 1,700° C., the turbine requires a cooling means. For this purpose, the turbine has cooling paths through which some of the compressed air is bled from some positions of the compressor and is supplied towards the turbine blades.

The cooling path may extend outside the housing (i.e., an external path), extend through the interior of the rotor disk (i.e., an internal path), or both the external and internal paths may be used. A plurality of film cooling holes 1344 are formed on a surface of the blade part 1343. The film cooling holes 1344 communicate with a cooling path formed inside the blade part 1343 to supply cooling air to the surface of the blade part 1343.

The blade part 1343 of the turbine is rotated by combustion gas in the housing, and a gap exists between an end of the blade part 1343 and the inner surface of the housing so that the blade part can rotate smoothly. However, because the combustion gas may leak through the gap, a sealing means is required to prevent the leakage.

Each of the turbine vane and the turbine blade having airfoil shape includes a leading edge, a trailing edge, a suction surface, and a pressure surface. The turbine vane and turbine blade have a complex path structure forming a cooling system. A cooling circuit in the turbine vane and turbine blade receives cooling fluid, e.g., air from the compressor and the fluid passes through the ends of the turbine vane and turbine blade. The cooling circuit includes a plurality of flow paths designed to maintain temperatures of all sides of the turbine vane and blade constant. At least a portion of the fluid passing through the cooling circuits is discharged through holes of the leading edge, the trailing edge, and the suction surface, and the pressure surface.

Figure 4:
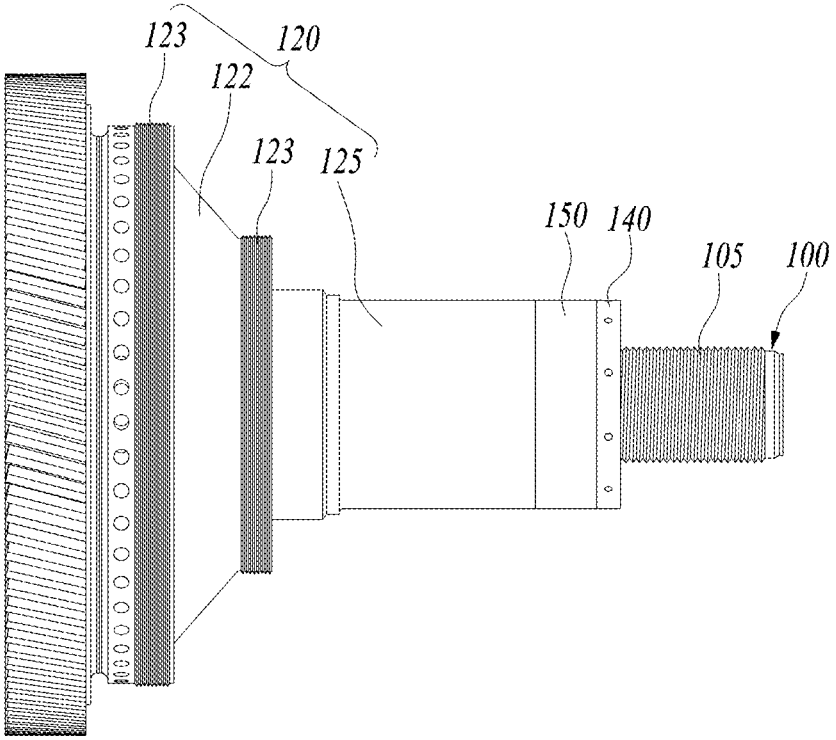
FIG. 4 is a front view illustrating a state in which a bearing support shaft and a first nut and a second nut are attached to a tie rod.
Figure 5:
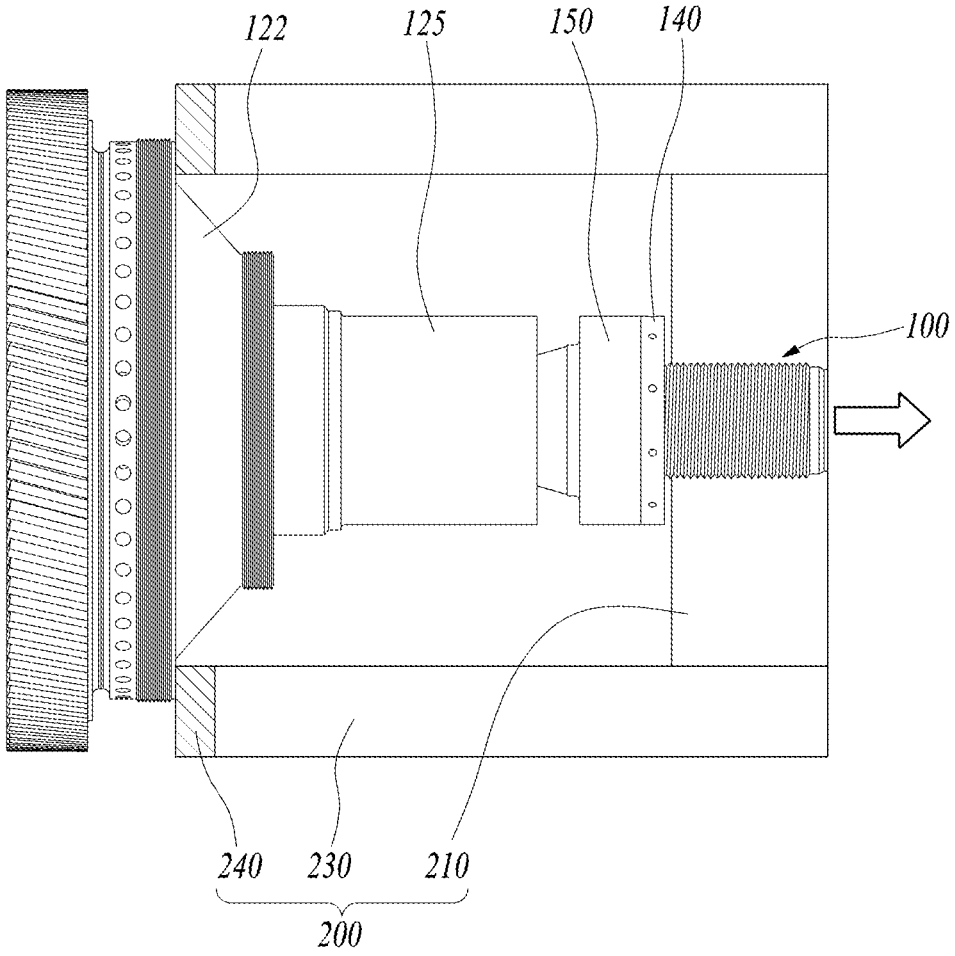
FIG. 5 is a front view illustrating a state in which the tie rod is tensioned by a tensioner in the state of FIG. 4.
Figure 6:
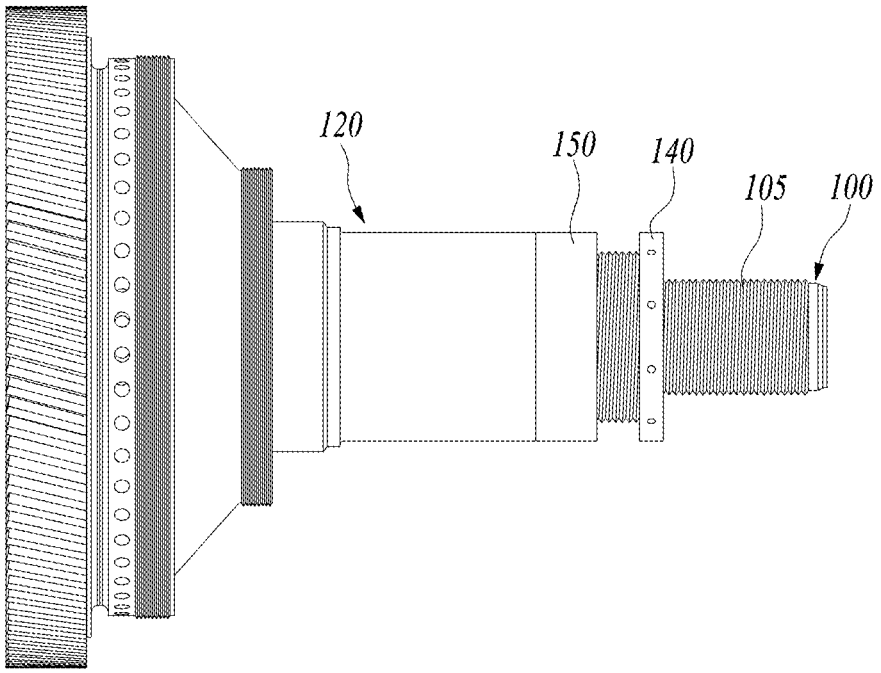
FIG. 6 is a front view illustrating a state in which the tie rod is first tensioned, and then the second nut is tightened in close contact with the bearing support shaft.
Figure 7:
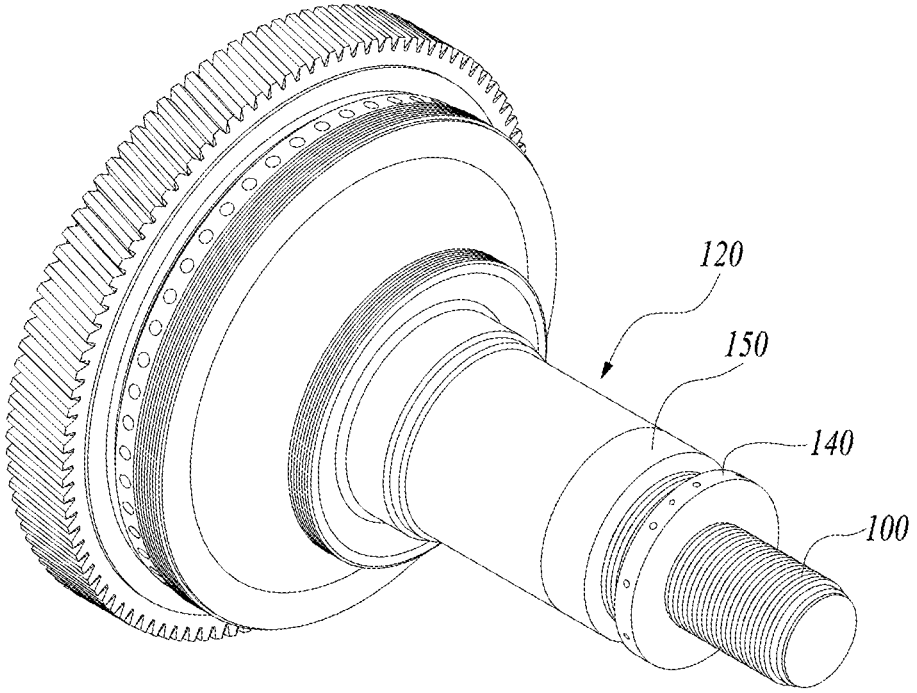
FIG. 7 is a perspective view illustrating a state in which the tie rod is first tensioned, and then the second nut is tightened in close contact with the bearing support shaft.
Figure 8:
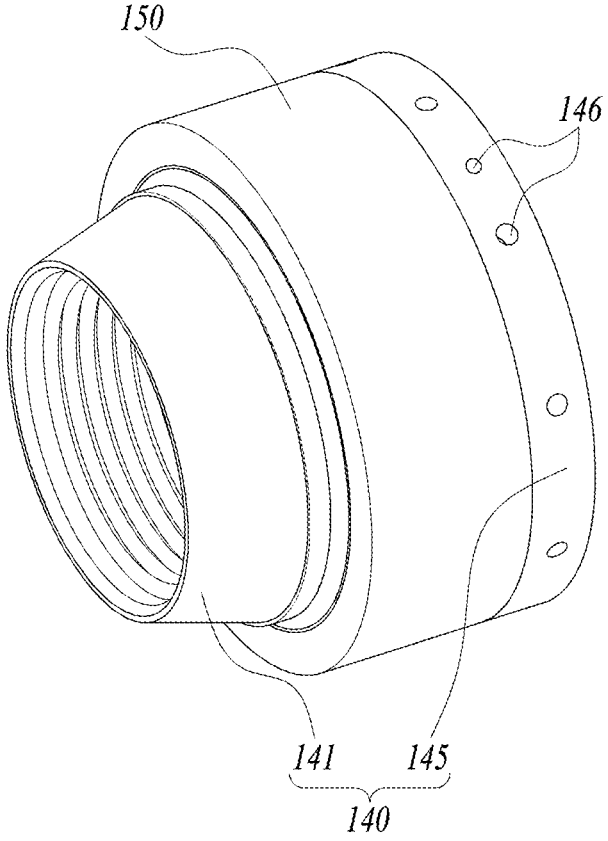
FIG. 8 is a perspective view illustrating a state in which the second nut is fastened to the first nut.
Figure 9:
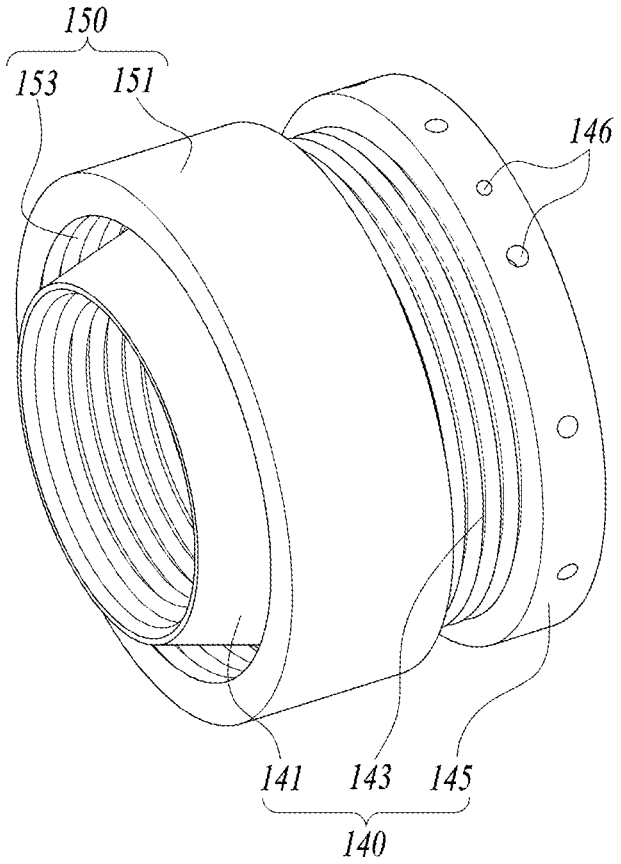
FIG. 9 is a perspective view illustrating a state in which the second nut is rotated and moved with respect to the first nut in the state of FIG. 8.
Figure 10:
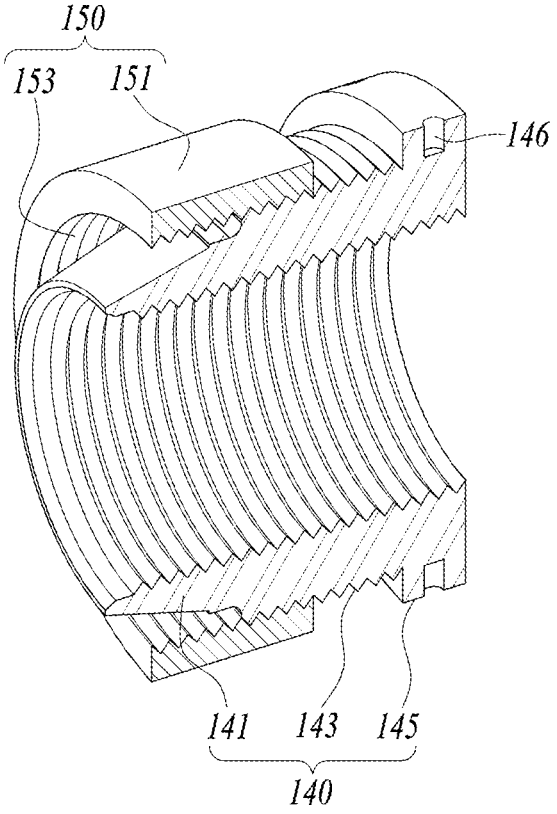
FIG. 10 is a partially cut-away perspective view of the first nut and the second nut in the state of FIG. 9.

FIG. 4 is a front view illustrating a state in which a bearing support shaft and a first nut and a second nut are attached to a tie rod, FIG. 5 is a front view illustrating a state in which the tie rod is tensioned by a tensioner in the state of FIG. 4, FIG. 6 is a front view illustrating a state in which the tie rod is first tensioned, and then the second nut is tightened in close contact with the bearing support shaft, FIG. 7 is a perspective view illustrating a state in which the tie rod is first tensioned, and then the second nut is tightened in close contact with the bearing support shaft, FIG. 8 is a perspective view illustrating a state in which the second nut is fastened to the first nut, FIG. 9 is a perspective view illustrating a state in which the second nut is rotated and moved with respect to the first nut in the state of FIG. 8, and FIG. 10 is a partially cut-away perspective view of the first nut and the second nut in the state of FIG. 9.

Referring to FIGS. 4 to 7, a tie rod assembly structure according to an exemplary embodiment includes a tie rod 100 on which a plurality of turbine rotor disks 1320 are mounted, a bearing support shaft 120 mounted to the tie rod 100 to support the turbine rotor disks and on which a bearing is mounted, a first nut 140 mounted on the tie rod 100 on one side of the bearing support shaft 120, and a second nut 150 that is fastened to the first nut 140 to tension the tie rod 100 and closely adheres to the bearing support shaft 120 to support the bearing support shaft 120.

For example, a plurality of turbine rotor disks 1320 are sequentially mounted on the left side of the tie rod 100, and as the tie rod 100 is tensioned, the plurality of turbine rotor disks 1320 can be fastened to the tie rod 100.

The bearing support shaft 120 is mounted on one side of the tie rod 100 to support the turbine rotor disks 1320. A thread 105 is formed on an outer circumferential surface of the tie rod 100 and a corresponding thread is formed on an inner circumferential surface of the bearing support shaft 120, so that the bearing support shaft 120 can be screwed and fastened to the tie rod 100. A bearing may be mounted on one side of the outer circumferential surface of the bearing support shaft 120.

The first nut 140 may be mounted around the tie rod 100 on one side of the bearing support shaft 120. The first nut 140 is disposed on one side of the bearing support shaft 120 such that the first nut 140 can be partially inserted into the bearing support shaft 120.

The second nut 150 can be screwed around the first nut 140, and after the tie rod 100 is tensioned, the second nut 150 is screwed toward the bearing support shaft 120 to support the bearing support shaft 120, thereby preventing axial movement of the bearing support shaft 120.

As illustrated in FIG. 4, the bearing support shaft 120 includes a rotor support 122 that supports one side of the turbine rotor disks 1320, and a bearing mount 125 integrally formed with the rotor support 122 to support a bearing mounted on an outer circumferential surface thereof.

The bearing support shaft 120 may have an internal threaded part, so that the bearing support shaft 120 can be screwed around and fastened to the tie rod 100.

The outer circumferential surface of the rotor support 122 may have a tapered shape with two or more stepped portions in which an outer diameter sharply changes. One side of the rotor support 122 in an axial direction can serve to fixedly support one side of the turbine rotor disks 1320 after the tie rod 100 is tensioned.

The bearing mount 125 is integrally formed with the rotor support 122 and may have a constant outer diameter. A bearing is mounted on the outer circumferential surface of the bearing mount 125 to rotatably support the rotor disks 1320 and the tie rod 100.

The bearing support shaft 120 may further include at least one seal 123 mounted on the rotor support 122. The rotor support 122 is provided with two grooves for mounting two seals 123 on both sides of the tapered inclined surface thereof, and two seals 123 having different diameters are inserted into and mounted on the two grooves. The two seals 123 serve to prevent leakage of the combustion gas between adjacent components.

Referring to FIGS. 8 to 10, the first nut 140 may include a tapered part 141 that may be inserted into one side of the bearing support shaft 120, a threaded part 143 integrally formed with the tapered part 141 and having an outer threaded portion, and a stepped part 145 integrally formed with the threaded part 143 and having an outer diameter larger than the threaded part 143.

The first nut 140 may have a variable outer diameter and a constant inner diameter, and a thread corresponding to the thread of the tie rod 100 may be formed on the inner circumferential surface.

The tapered part 141 may be formed on one side of the first nut 140 so that the tapered part 141 may be selectively inserted into one side of the bearing support shaft 120. To this end, a groove capable of accommodating the tapered part 141 may be internally formed on one side of the bearing support shaft 120.

The threaded part 143 is integrally formed with the tapered part 141 such that the treaded part 143 has a threaded outer circumferential surface with an outer diameter larger than that of the tapered part 141 and through which the second nut 150 may be screwed and fastened.

The stepped part 145 may be integrally formed with the threaded part 143 such that the stepped part 145 may have an outer diameter larger than that of the threaded part 143. The stepped part 145 serves to prevent the second nut 150 fastened to the threaded part 143 from moving by rotating to one side in the axial direction.

A plurality of holes 146 for rotating the first nut 140 may be formed on the outer circumferential surface of the stepped part 145. Each hole 146 may be formed in a circular or hexagonal hole shape having a predetermined depth. The plurality of holes 146 (e.g., 2 to 16 holes) may be arranged at regular or arbitrary intervals from each other. The first nut 140 can be easily fastened to the tie rod 100 by inserting a tool such as a wrench into the holes 146 and rotating the first nut 140.

The second nut 150 may include a body part 151 mounted on the threaded part 143 of the first nut 140 and a threaded part 153 formed on an inner circumferential surface of the body part 151.

The body part 151 of the second nut 150 may have a circular band shape in which a thread is formed on the inner circumferential surface. An axial length of the body part 151 may be equal to an axial length of the threaded part 143 of the first nut 140.

The threaded part 153 is formed to correspond to the threaded part 143 of the first nut 140 so as to be fastened to the threaded part 143 of the first nut 140. The second nut 150 may be rotated by the threaded part 153 to move by a predetermined distance in the axial direction around the threaded part 143 of the first nut 140.

The stepped part 145 of the first nut 140 may be formed to have an outer diameter equal to that of the second nut 150 and the bearing mount 125. Thus, an inner diameter of a casing surrounding the bearing mount 125, the second nut 150, and stepped part 145 of the first nut 140 may be formed uniformly.

A method of assembling tie rod according to an exemplary embodiment will be described with reference to FIGS. 4 to 7.

First, a plurality of turbine rotor disks 1320 are mounted on the tie rod 100. For example, FIG. 2 illustrates that the plurality of turbine rotor disks 1320 are mounted on the tie rod 100.

Subsequently, the bearing support shaft 120 is mounted on the tie rod 100. Because the bearing support shaft 120 is screwed to the tie rod 100, the bearing support shaft 120 may be screwed and fastened to one side of the turbine rotor disks 1320 on the downstream side.

Subsequently, as illustrated in FIG. 4, the first nut 140 to which the second nut 150 is fastened is mounted and fastened to the tie rod 100 such that one side of the second nut 150 is in close contact with the stepped part 145 of the first nut 140, and the other side of the second nut 150 comes into contact with the bearing support shaft 120.

When the first nut 140 is fastened, the first nut 140 to which the second nut 150 is screwed is fastened to the threaded tie rod 100 such that the second nut 150 is in close contact with one side of the bearing support shaft 120.

Subsequently, as illustrated in FIG. 5, the tie rod 100 is tensioned using a tensioner 200. The tensioner 200 may include a fastening part 210 fastened to an end of the tie rod 100 to tension the tie rod 100, a support bar 230 extending from the fastening part 210 toward the rotor support 122 of the bearing support shaft 120, and a support pad 240 provided on an end side of the support bar 230 to elastically support one side of the rotor support 122.

The fastening part 210 may be coupled to an end side of the tie rod 100 by forming a threaded inner circumferential surface.

The support bar 230 maintains a fixed state while the fastening part 210 moves. In other words, the tie rod 100 can be tensioned by relatively moving the fastening part 210 in a state in which the support pad 240 is in close contact with the rotor support 122 and the support bar 230 is fixed.

The support pad 240 is formed of an elastic material and a plurality of support pads 240 are disposed to prevent damage to the rotor support 122 when the tie rod 100 is tensioned.

When the tie rod 100 is tensioned, the internal threaded part of the first nut 140 fastened to the tie rod 100 may also be tensioned in the axial direction. In this case, a problem may arise in that the internal threaded part of the first nut 140 is deformed, so that the first nut 140 cannot rotate with respect to the tie rod 100.

When the tie rod 100 is tensioned, the first nut 140 may be moved a predetermined distance from one side of the bearing support shaft 120 during the tensioning of the tie rod 100.

As illustrated in FIGS. 6 and 7, the tensioner 200 is removed from the tie rod 100, and the second nut 150 is screwed in close contact with one side of the bearing support shaft 120.

Even if the internal threaded part of the first nut 140 is deformed, the outer threaded part of the first nut 140 is not deformed. Therefore, by screwing the second nut 150 to the first nut 140 after the tie rod 100 is tensioned, the second nut 150 may be brought into close contact with one side of the bearing support shaft 120 to support the bearing support shaft 120.

In other words, when the second nut 150 is brought into close contact with one side of the bearing support shaft 120, the second nut 150 may be fastened to the first nut 140 to support the bearing support shaft 120 to prevent movement around the tie rod 100.

While one or more exemplary embodiments have been described with reference to the accompanying drawings, it is to be apparent to those skilled in the art that various modifications and variations in form and details can be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A tie rod assembly structure comprising:

a tie rod on which a plurality of rotor disks are mounted;

a bearing support shaft mounted to the tie rod to support the rotor disks and on which a bearing is mounted;

a first nut mounted on the tie rod on one side of the bearing support shaft; and a second nut that is screwed to the first nut to tension the tie rod and then is in close contact with the bearing support shaft to support the bearing support shaft.

2. The tie rod assembly structure according to claim 1, wherein the bearing support shaft comprises:

a rotor support that supports one side of the rotor disks; and a bearing mount that is integrally formed with the rotor support to support a bearing mounted on an outer circumferential surface thereof.

3. The tie rod assembly structure according to claim 2, wherein the bearing support shaft further comprises at least one seal mounted on the rotor support.

4. The tie rod assembly structure according to claim 3, wherein the first nut comprises:

a tapered part inserted into one side of the bearing support shaft;

a threaded part integrally formed with the tapered part and having a threaded outer circumferential surface; and a stepped part integrally formed with the threaded part and having a larger outer diameter than the threaded part.

5. The tie rod assembly structure according to claim 4, wherein the second nut comprises:

a body part mounted on the threaded part of the first nut; and a threaded part formed on an inner circumferential surface of the body part.

6. The tie rod assembly structure according to claim 5, wherein the outer diameter of the stepped part of the first nut is the same as an outer diameter of the second nut and the bearing mount.

7. The tie rod assembly structure according to claim 5, wherein the first nut further comprises a plurality of holes formed on an outer circumferential surface of the stepped part to rotate the first nut.

8. A gas turbine comprising:

a compressor configured to compress external air;

a combustor configured to mix fuel with air compressed by the compressor to combust an air-fuel mixture; and a turbine having a turbine blade mounted on a turbine rotor disk and configured to be rotated by the combustion gas discharged from the combustor, wherein the turbine comprises:

a tie rod on which a plurality of rotor disks are mounted;

a bearing support shaft mounted to the tie rod to support the rotor disks and on which a bearing is mounted;

a first nut mounted on the tie rod on one side of the bearing support shaft; and a second nut that is screwed to the first nut to tension the tie rod and then is in close contact with the bearing support shaft to support the bearing support shaft.

9. The gas turbine according to claim 8, wherein the bearing support shaft comprises:

a rotor support that supports one side of the rotor disks; and a bearing mount that is integrally formed with the rotor support to support a bearing mounted on an outer circumferential surface thereof.

10. The gas turbine according to claim 9, wherein the bearing support shaft further comprises at least one seal mounted on the rotor support.

11. The gas turbine according to claim 10, wherein the first nut comprises:

a tapered part inserted into one side of the bearing support shaft;

a threaded part integrally formed with the tapered part and having a threaded outer circumferential surface; and a stepped part integrally formed with the threaded part and having a larger outer diameter than the threaded part.

12. The gas turbine according to claim 11, wherein the second nut comprises:

a body part mounted on the threaded part of the first nut; and a threaded part formed on an inner circumferential surface of the body part.

13. The gas turbine according to claim 12, wherein the outer diameter of the stepped part of the first nut is the same as an outer diameter of the second nut and the bearing mount.

14. The gas turbine according to claim 12, wherein the first nut further comprises a plurality of holes formed on an outer circumferential surface of the stepped part to rotate the first nut.

15. A method of assembling tie rod comprising:

mounting a plurality of rotor disks on a tie rod;

mounting a bearing support shaft on the tie rod;

fastening a first nut to which a second nut is fastened to the tie rod;

tensioning the tie rod with a tensioner; and screwing the second nut to come into close contact with one side of the bearing support shaft.

16. The method according to claim 15, wherein in fastening the first nut, the first nut to which the second nut is fastened is fastened to the threaded tie rod so that the second nut is in close contact with one side of the bearing support shaft.

17. The method according to claim 16, wherein in tensioning the tie rod, the first nut is moved a predetermined distance from one side of the bearing support shaft during the tensioning of the tie rod.

18. The method according to claim 16, wherein in screwing the second nut to come into close contact with one side of the bearing support shaft, the second nut is fastened with respect to the first nut to support the bearing support shaft to prevent movement around the tie rod.

19. The method according to claim 15, wherein the tensioner comprises a fastening part fastened to an end of the tie rod to tension the tie rod, a support bar extending from the fastening part toward a rotor support of the bearing support shaft, and a support pad provided on an end side of the support bar to elastically support one side of the rotor support of the bearing support shaft.

20. The method according to claim 19, wherein the tensioning the tie rod comprises relatively moving the fastening part in a state in which the support pad is in close contact with the rotor support and the support bar is fixed.

* * * * *